United States Patent [19]

Weis

[11] Patent Number: 4,661,047

[45] Date of Patent: Apr. 28, 1987

[54] SUBMERSIBLE PUMP GUIDE RAIL ARRANGEMENT

[75] Inventor: Frank G. Weis, Kansas City, Mo.

[73] Assignee: Smith & Loveless, Lenexa, Kans.

[21] Appl. No.: 842,932

[22] Filed: Mar. 24, 1986

[51] Int. Cl.[4] ..... F04B 17/00; F04B 35/00

[52] U.S. Cl. ..... 417/360; 417/361

[58] Field of Search ..... 417/360, 361; 285/24, 285/27, 325; 166/68.5, 69, 85; 415/126, 201

[56] References Cited

U.S. PATENT DOCUMENTS

| | | | |
|---|---|---|---|
| 3,018,925 | 1/1962 | Englesson | 417/360 |
| 3,427,982 | 2/1969 | Englesson | 417/360 |
| 3,771,914 | 11/1973 | Crespo | 417/360 |
| 3,771,915 | 11/1973 | Back | 417/360 |
| 4,011,532 | 3/1977 | Williams et al. | 285/325 |
| 4,043,707 | 8/1977 | Heumann et al. | 417/360 |
| 4,392,790 | 7/1983 | Shibata et al. | 417/360 |

FOREIGN PATENT DOCUMENTS

| | | | |
|---|---|---|---|
| 1187931 | 2/1965 | Fed. Rep. of Germany | 417/360 |

*Primary Examiner*—Carlton R. Croyle
*Assistant Examiner*—Donald E. Stout
*Attorney, Agent, or Firm*—Dressler, Goldsmith, Shore, Sutker & Milnamow

[57] ABSTRACT

A submersible pump guide rail arrangement which utilizes the discharge conduit as the guide rail about which the submersible pump assembly is raised and lowered within a wet well. The discharge conduit is rectangular in cross-section and a guide means, having spaced apart V-shaped recesses, receives opposing corners of the discharge conduit thereinto.

8 Claims, 2 Drawing Figures

SUBMERSIBLE PUMP GUIDE RAIL ARRANGEMENT

BACKGROUND OF THE INVENTION

The present invention relates to a submersible pump arrangement and more particularly to a coupling system for a submersible pump assembly adapted to be coupled to and decoupled from a discharge conduit immersed in a liquid receiving wet well.

It has heretofore been proposed to provide a detachable coupling system for a submersible pump assembly to effect coupling and decoupling thereof from a discharge conduit adjacent the bottom of a wet well without need of access by an operator to the bottom of the wet well. Such a coupling system is desired because the submersible pump assembly is typically immersed under brackish water or sewage. The decoupling of the pump assembly and the removal of same from the wet well is periodically necessary for service. Thus, it is a well known practice to provide a detachable coupling system that permits the raising and lowering of a submersible pump assembly from a wet well without the unbolting of any piping.

It has been the heretofore practice to provide a self aligning wedge connection between the submersible pump assembly and a base elbow pipe which communicates with the discharge conduit. However, upon lowering of the submersible pump assembly, there must be some type of guide rail system to guide the faces of the coupling into alignment and connecting seal with the base elbow pipe. Prior solutions have incorporated various guide rail arrangements. All of such arrangements are quite similar, in that separate guide rail structural members are provided whose sole purpose is to guide the submersible pump assembly into connection with the base discharge elbow. These guide rails typically extend into the wet well and are positioned either adjacent to the pump discharge flange or adjacent to the pump volute. The pump assembly is typically provided with recesses that fit partially around the guide rails so that the pump assembly will follow the rails as it is raised and lowered. Examples of such systems are disclosed in U.S. Pat. Nos. 3,427,982, 3,656,871 and 4,392,790.

Such guide rail arrangements have several disadvantages. The guide rails are typically of small diameter and tend to bend if the pump does not lift evenly. The addition of guide rails into the wet well presents additional members that tend to collect rags, paper, plastic bags, etc. The installing contractor has additional pieces to install and keep track of. The guide rails and attachments increase the cost of the system.

SUMMARY OF THE INVENTION

The present invention is an improvement on the hereinabove discussed guide rail arrangements and eliminates the above-mentioned disadvantages associated therewith. The submersible pump guide rail arrangement of the invention utilizes the discharge conduit as the guide rail for raising and lowering a submersible pump assembly. The discharge conduit in accordance with the invention is preferably rectangular in cross-section. The submersible pump assembly is provided with guide means which is slidably received about the discharge conduit. As the pump assembly is raised and lowered, the guide means keeps the pump assembly aligned with the discharge conduit to ensure proper coupling of the pump assembly with the discharge conduit.

More specifically, the guide means includes a first end portion which is rigidly secured to the pump assembly and a second end portion which is formed with opposing V-shaped recesses which slidably receive opposing corners of the discharge conduit. A lower portion of the discharge conduit is secured to a substantially horizontal first coupling member having a first end portion in fluid communication therewith and a second end portion in fluid communication with the submersible pump assembly. The submersible pump assembly has a volute chamber outlet having a substantially horizontal second coupling member rigidly secured thereto. The second coupling member has a first end portion in fluid communication with the volute chamber outlet and a second end portion in fluid communication with the second end of the first coupling member. The second end portions of the first and second coupling members have cooperating wedge faces which contact each other in juxtaposed abutting sealing engagement as the pump assembly attains its lowered position.

The pump guide rail arrangement of the present invention eliminates the necessity of providing separate structural guide rail members. The discharge conduit is a heavy structural member which resists bending if the pump assembly should bind during the raising and lowering thereof. The arrangement is easier to install since the discharge conduit also serves as the guide rail and is therefore less expensive. Also, the elimination of the separate guide rail members reduces the likelihood of collecting rags, paper, etc. within the wet well.

The present invention and the advantages thereof will become more apparent from the description of the preferred embodiments which hereinbelow follow with reference to the accompanying drawings.

DESCRIPTION OF PREFERRED EMBODIMENT OF THE INVENTION

Figure 1:
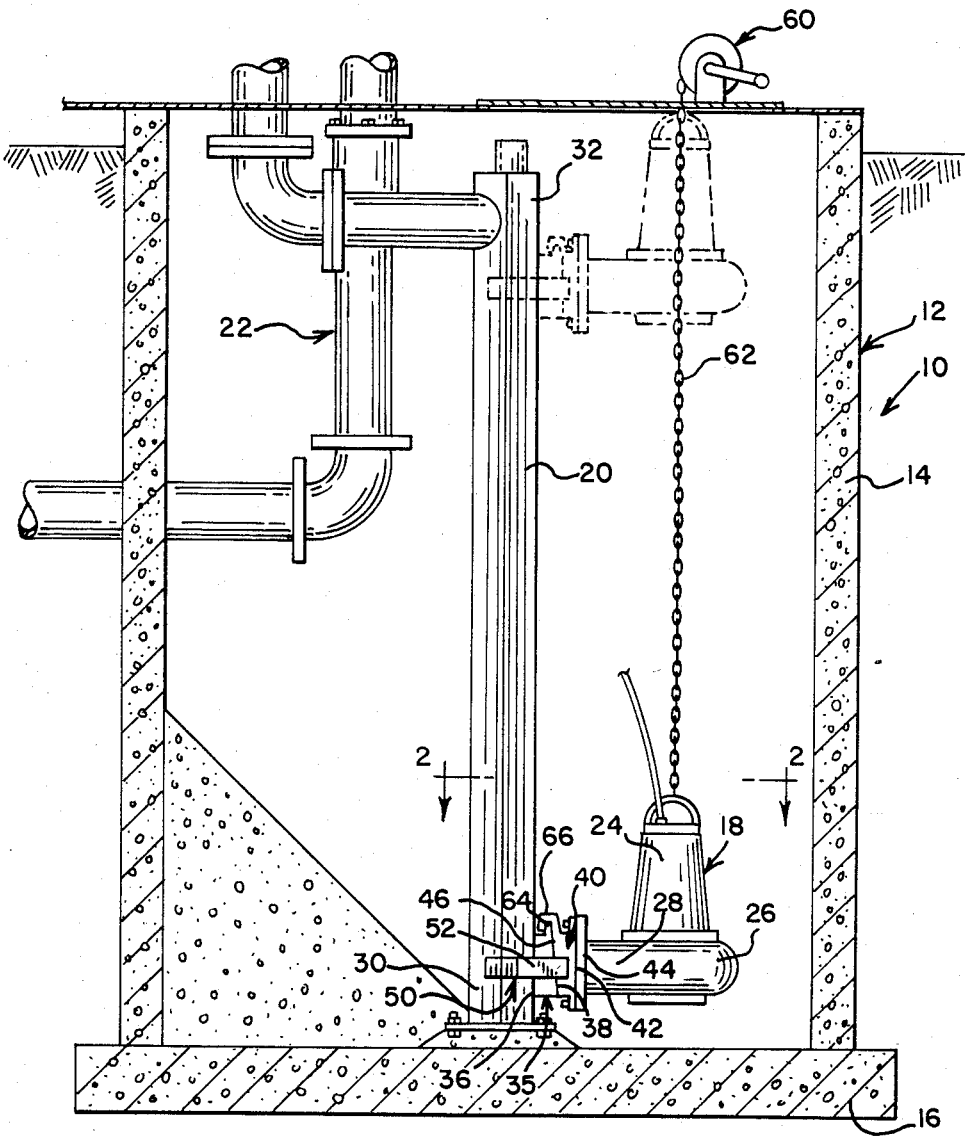
FIG. 1 is a vertical cross-sectional view taken through an exemplary wet well having a submersible pump assembly positioned therein which incorporates the guide radial arrangement of the present invention.

Referring to FIG. 1, a portion of an exemplary submersible pumping system 10 is shown including a wet well chamber 12 having upstanding sidewalls 14 and a floor 16. A submersible pump assembly 18, of well-known construction, is positioned within the wet well 12 for pumping liquid within the wet well 12 through a discharge conduit 20 and an arrangement of outlet piping 22 in a conventional manner. Submersible pump assembly 18 includes a motor assembly 24, a volute chamber 26, and a volute chamber outlet 28. For reasons as hereinabove discussed, it is desirable to mount submersible pump assembly 18 in a manner which facilitates the positioning thereof between a first or lower position, as shown in solid lines in FIG. 1, and a second or upper position, as shown in phantom lines in FIG. 1.

As alluded to hereinabove, the present invention is directed to an improved arrangement for selectively raising and lowering pump assembly 18 between its first and second positions. The arrangement of the invention utilizes the discharge conduit 20 as a guide rail about which the pump assembly 18 is raised and lowered within the wet well 12.

Figure 2:
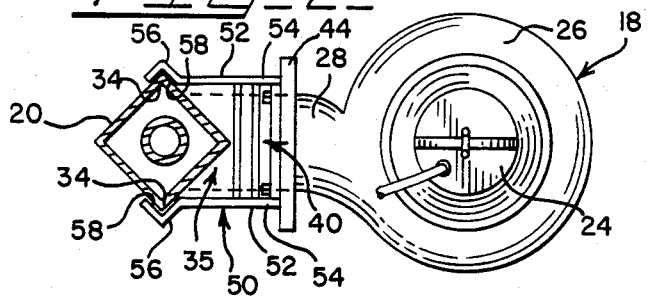
FIG. 2 is a cross-sectional view taken along line 2—2 of FIG. 1.

Referring to FIGS. 1 and 2, in accordance with a preferred embodiment of the invention, discharge conduit 20 is preferably formed from a length of pipe having a rectangular cross-section. Discharge conduit 20 has a lower portion 30 which is suitably secured to floor 16 in a well-known manner and an upper portion 32 which extends upwardly in wet well 12 and communicates with piping 22. Conduit 20 is preferably oriented such that a pair of opposing corners 34 thereof are oriented as shown in FIG. 2 for reasons which will hereinbelow become more apparent. Lower portion 30 is provided with an opening therethrough which communicates with a substantially horizontal hollow coupling member 35 secured to discharge conduit 20. Coupling member 35 has a first end portion 36 in fluid communication with the opening in discharge conduit 20 and a second end portion 38 which communicates with volute chamber outlet 28 when pump assembly 18 is in its first position.

A substantially horizontal hollow coupling member 40 is secured to volute chamber outlet 28. Coupling member 40 has a first end portion 42 which is secured to volute chamber outlet 28 through a flange 44 in a suitable manner and a second end portion which contacts and communicates with end portion 38 of coupling member 35 when the pump assembly 18 is in its first position. In a manner well-known in the art, second end portions 38 and 46 have opposing inclined wedge faces which contact each other in juxtaposed abutting and sealing engagement as the pump assembly 18 moves into its first position.

In order to guide the movement of pump assembly 18 between its first and second positions, a guide assembly 50 is secured to coupling member 40 and thereby movable with pump assembly 18 and is received about discharge conduit 20 for selective vertical movement along the length thereof. Guide assembly 50, in accordance with a preferred embodiment of the invention, includes a pair of substantially horizontal spaced apart guide members 52 having first end portions 54 which are suitably secured to coupling member 40 and second end portions 56 which are received about corners 34 of discharge conduit 20. End portions 56 are preferably formed with V-shaped recesses 58 which receive corners 34 thereinto, as best seen in FIG. 2.

The raising of pump assembly 18 may be accomplished in various ways. For example, a chain and hoist arrangement 60 of conventional construction may be utilized to lift pump assembly 18 via chain 62. Upon application of an upward force to pump assembly 18 through chain 62, the pump assembly, coupling member 40 and guide means 50 are lifted as an integral unit. The upward and downward movement of such unit is guided by the movement of guide members 52 along the length of discharge conduit 20.

In accordance with a preferred embodiment of the invention, coupling member 35 is provided with an upstanding flange member 64 and coupling member 40 is provided with a wedge hook 66. As pump assembly 18 reaches its first position, the flange member 64 is received in wedge hook 66 and thereby precludes further downward movement of pump assembly 18, ensuring the proper alignment of coupling members 34 and 40.

As will be readily appreciated from the above description, the pump guide radial arrangement of the present invention eliminates the necessity of providing separate guide rail members within the wet well to guide the movement of the pump assembly. The discharge conduit 20 serves the dual purpose of receiving liquid from the volute chamber outlet and acts as a guide rail to guide movement of the pump assembly. The discharge conduit being a heavy structural member resists bending if the pump assembly should bind during the raising and lowering thereof. The elimination of the use of separate guide rail members to guide the movement of the pump assembly reduces the likelihood of collecting debris within the wet well and facilitates the installation and thereby reduces cost.

While certain preferred embodiments of the invention have been specifically disclosed, it is understood that the invention is not limited thereto, as many variations will be readily apparent to those skilled in the art and the invention is to be given its broadest interpretation within the terms of the following claims.

What is claimed is:

1. In a submersible pump station having a wet well for receipt of a liquid thereinto; an improved submersible pump assembly for pumping liquid from said wet well, comprising: a substantially vertical discharge conduit of rectangular cross-section extending into said wet well having a lower portion positioned adjacent the bottom of said wet well and an upper portion positioned above said lower portion; a submersible pump means positioned within said wet well moveable between a first position in fluid communication with said lower portion of said discharge conduit and a second position adjacent said upper portion of said discharge conduit; and guide means associated with said submersible pump means for guiding the movement of said submersible pump means between its first and second positions, said guide means being received by said discharge conduit for selective vertical movement along the length of said discharge conduit, said guide means having a first end portion which is secured to said submersible pump means and a second end portion which is slidably received about at least two opposing corners of said discharge conduit.

2. The invention as defined in claim 1 wherein said guide means includes a pair of spaced apart guide members which define spaced apart V-shaped recesses for receipt of said opposing corners thereinto.

3. The invention as defined in claim 1 wherein said lower portion of said discharge conduit is provided with a substantially horizontal first coupling member rigidly secured thereto, said first coupling member having a first end portion in fluid communication with said discharge conduit and a second end portion in fluid communication with said submersible pump means.

4. The invention as defined in claim 3 wherein said submersible pump means has a volute chamber outlet having a substantially horizontal second coupling member rigidly secured thereto, said second coupling member having a first end portion in fluid communication with said volute chamber outlet and a second end portion in fluid communication with said second end portion of said first coupling member.

5. The invention as defined in claim 4 wherein said second end portion of said first coupling member and said second end portion of said second coupling member have cooperating wedge faces which contact each other in juxtaposed abutting engagement as said submersible pump means moves into its first position.

6. The invention as defined in claim 5 wherein said first coupling member is provided with an upstanding flange member which receives a wedge hook provided on said second member as said submersible pump means moves into its first position.

7. In a submersible pump station having a wet well for receipt of a liquid thereinto; an improved submersible pump assembly for pumping liquid from said wet well, comprising: a substantially vertical discharge conduit extending into said wet well having a unitary wall member defining inside and outside surfaces which are geometrically similar, said discharge conduit having a lower portion positioned adjacent the bottom of said wet well and an upper portion positioned above said lower portion; a submersible pump means positioned within said wet well moveable between a first position in fluid communication with said lower portion of said discharge conduit and a second position adjacent said upper portion of said discharge conduit; and guide means associated with said submersible pump means for guiding the movement of said submersible pump means between its first and second positions, said guide means being received by said discharge conduit for selective vertical movement along the length of said discharge conduit, said guide means having a first end portion which is secured to said submersible pump means and a second end portion which is slidably received about said outer surface of said discharge conduit.

8. The invention as defined in claim 7 wherein outside surface of said discharge conduit defines a plurality of apices and said second end portion of said guide means is slidably received about at least two opposing apices thereof.

* * * * *